US006553873B2

(12) United States Patent
Collins et al.

(10) Patent No.: US 6,553,873 B2
(45) Date of Patent: Apr. 29, 2003

(54) HYDRAULIC WRENCH CONTROL VALVE SYSTEMS

(75) Inventors: Bobby Collins, Kenner, LA (US); Michael Shirey, New Orleans, LA (US)

(73) Assignee: Power Tork Hydraulics, Inc., Kenner, LA (US)

( * ) Notice: Subject to any disclaimer, the term of this patent is extended or adjusted under 35 U.S.C. 154(b) by 0 days.

(21) Appl. No.: 09/847,697

(22) Filed: May 2, 2001

(65) Prior Publication Data

US 2002/0005092 A1 Jan. 17, 2002

Related U.S. Application Data

(60) Provisional application No. 60/201,434, filed on May 3, 2000.

(51) Int. Cl.[7] ..... B25B 13/46
(52) U.S. Cl. ..... 81/57.39; 81/57.44
(58) Field of Search ..... 81/57.14, 57.22, 81/57.39, 57.44, 58.1

(56) References Cited

U.S. PATENT DOCUMENTS

| | | | |
|---|---|---|---|
| 2,702,489 | A | 2/1955 | Wallace, Sr. |
| 2,720,803 | A | 10/1955 | Rice et al. |
| 2,867,144 | A | 1/1959 | Stevens |
| 3,575,069 | A | 4/1971 | White |
| 3,586,115 | A | 6/1971 | Amtsberg |
| 3,686,983 | A | 8/1972 | Flagge |
| 3,733,935 | A | 5/1973 | Tsuji |
| 3,739,659 | A | 6/1973 | Workman, Jr. |
| 3,845,673 | A | 11/1974 | Karden et al. |
| 3,939,924 | A | 2/1976 | Grabovac |
| 3,965,775 | A | 6/1976 | Aspers et al. |
| 4,054,067 | A | 10/1977 | Blank |
| 4,200,011 | A | 4/1980 | Wilmeth |
| 4,258,594 | A | 3/1981 | Welch |

(List continued on next page.)

FOREIGN PATENT DOCUMENTS

| | | |
|---|---|---|
| DE | 3534431 | 9/1985 |
| GB | 2 083 392 | 3/1982 |
| WO | PCT/US94/14715 | 6/1996 |
| WO | WO96/19322 | 6/1996 |
| WO | PCT/US96/10660 | 1/1997 |

*Primary Examiner*—James G. Smith
(74) *Attorney, Agent, or Firm*—Roy, Kiesel, Keegan and DeNicola

(57) ABSTRACT

A wrench assembly including a drive head and an attached socket for engaging a bolt or nut. When the drive head turns, the socket and any engaged threaded member will also rotate. A hydraulic motor and cylinder are also included. The hydraulic motor and cylinder rotate the drive head and socket independently of each other. Typically, the hydraulic motor will rotate the drive head faster than the cylinder but at lower torques. Thus, the hydraulic motor will spin the threaded member down until it is snug, and then the hydraulic cylinder will tighten the threaded member to the desired torque. Alternatively, the hydraulic cylinder may break the threaded member out when it is tight. The hydraulic motor will then spin the loosened threaded member out. Finally, the wrench assembly includes a hydraulic fluid distribution system, including one or more valves that regulate hydraulic fluid flow through the wrench assembly.

22 Claims, 5 Drawing Sheets

U.S. PATENT DOCUMENTS

| | | | | |
|---|---|---|---|---|
| 4,300,641 | A | | 11/1981 | Kinkel |
| 4,325,274 | A | | 4/1982 | Martelee |
| 4,403,663 | A | | 9/1983 | Janssen |
| 4,513,827 | A | | 4/1985 | Dubiel |
| 4,522,269 | A | | 6/1985 | Adman et al. |
| 4,538,484 | A | | 9/1985 | Hardy et al. |
| 4,592,256 | A | | 6/1986 | Bosque |
| 4,669,338 | A | | 6/1987 | Collins |
| 4,671,142 | A | | 6/1987 | Junkers |
| 4,679,469 | A | | 7/1987 | Coyle, Sr. |
| 4,744,271 | A | | 5/1988 | Collins |
| 4,794,825 | A | | 1/1989 | Schmoyer |
| 4,846,028 | A | | 7/1989 | Junkers |
| 4,898,248 | A | | 2/1990 | Thompson |
| 4,982,626 | A | | 1/1991 | More et al. |
| 5,005,654 | A | | 4/1991 | Moriki et al. |
| 5,010,792 | A | | 4/1991 | Clarno |
| 5,097,730 | A | | 3/1992 | Bernard et al. |
| 5,103,696 | A | | 4/1992 | Beuke |
| 5,203,238 | A | | 4/1993 | Ferguson |
| 5,203,242 | A | | 4/1993 | Hansson |
| 5,249,486 | A | | 10/1993 | Thompson et al. |
| 5,301,574 | A | | 4/1994 | Knopp et al. |
| 5,388,478 | A | | 2/1995 | Castle |
| 6,119,557 | A | * | 9/2000 | Penisson ..... 81/57.44 |

* cited by examiner

HYDRAULIC WRENCH CONTROL VALVE SYSTEMS

BENEFIT OF PROVISIONAL APPLICATION

This application claims benefit of provisional application No. 60/201,434, which was filed on May 3, 2000, and which is hereby incorporated by reference in its entirety.

BACKGROUND OF THE INVENTION

1. Field of the Invention

The invention relates to valves in general, hydraulic valves in particular, and especially to a control valve for a hydraulic torque wrench with a hydraulic spin down motor.

2. Prior Art

The use of hydraulic wrenches to tighten (make up) or loosen (break out) nuts or bolts in high torque applications, such as the erection of off shore risers is well known. See, e.g., U.S. Pat. No. 4,448,096, which is hereby incorporated by reference. These wrenches are well suited to the task of supplying the high torques needed in these applications, however, they are very slow in turning the bolt or nut being tightened or loosened. This is not a problem when the nut or bolt is snug, as very little additional rotation ($\lesssim 1$ full rotation) is all that is usually required to either reach the desired torque or to loosen the nut/bolt to the point that the high torque wrench is no longer needed to turn the nut/bolt. However, when the nut or bolt is not snug, the hydraulic torque wrench can be painfully slow. In the prior art, hydraulic torque wrenches were frequently removed after the bolt/nut was loosened and a low torque spin down wrench would then be used to back the bolt/nut out. Similarly, the low torque spin down wrench might be used to spin the bolt/nut down until it was snug, and then the hydraulic torque wrench would be used to fully tighten the bolt/nut. These wrenches are typically quite large, and changing them out constantly during a job can be expensive and time consuming. In response to these inconveniences, hydraulic torque wrenches that included a self-contained spin down motor were developed. See, e.g., U.S. patent application Ser. No. 09/302,836, which is hereby incorporated by reference in its entirety. However, the prior art combined wrenches, such as that disclosed in PCT/US94/14715, had numerous problems. Some of the problems included complicated and expensive hydraulic controls, troublesome back pressure valves, and an inability to use hydraulic sources already in place, such as the drilling rig hydraulic lines. Accordingly, a hydraulic control system that meets the following objects is desired.

OBJECTS OF THE INVENTION

It is an object of the invention to provide a control system for a combination hydraulic torque wrench and spin down motor.

It is an object of the invention to provide a control system for a combination hydraulic torque wrench and spin down motor which will only run the spin down motor when the hydraulic torque wrench is retracted.

It is an object of the invention to provide a control system for a combination hydraulic torque wrench and spin down motor that will only extend the hydraulic torque wrench when the spin down motor is off.

It is an object of the invention to provide a control system for a combination hydraulic torque wrench and spin down motor that does not require a back pressure valve.

It is an object of the invention to provide a control system for a combination hydraulic wrench and spin down motor that will operate on rig hydraulics.

It is an object of the invention to provide a control system for a combination hydraulic torque wrench and spin down motor that does not require a control console separate from the wrench.

SUMMARY OF THE INVENTION

The invention is intended for use with a hydraulic torque wrench having a built in run down motor. The hydraulic torque wrench essentially comprises a drive head having a socket configured to engage a threaded member such as a bolt or a nut. The drive head has a plurality of ratchet teeth radially positioned on the drive head. A hydraulic cylinder is configured to extend and retract a drive pawl which engages the ratchet teeth upon extension and thus rotates the drive head. Rotation of the drive head results in the rotation of the socket and the threaded member which the socket has engaged. Very high pressures can be exerted against the drive head with the hydraulic cylinder, resulting in torques in the range of about 10,000 to upward of 34,000 ft. lbs. being applied to the threaded member being tightened or loosened. Examples of this type of torque wrench can be found in U.S. Pat. No. 4,448,096.

The spin down motor is also preferably hydraulically driven. It is mechanically coupled to the drive head. Although the spin down motor is not configured to generate the very high torques that the hydraulic cylinder is designed to create, it is capable of rotating the drive head much faster than the hydraulic cylinder. In the preferred embodiment, the hydraulic spin down motor will typically generate about 500 ft lbs. of torque and rotate the drive head at about 585 rotations per minute (rpm's). Torque from spin down motor may be improved, at the price of speed, by adding pulleys or gears as disclosed in U.S. application Ser. No. 09/302,836. The spin down motor is used to either spin the threaded member into a snug position during make up or to spin the threaded member until it is nearly or fully disengaged during break out. Examples of torque wrench assemblies incorporating hydraulic spin down motors may be found in U.S. patent application Ser. No. 09/302,836 and in PCT/US94/14715.

The valve of the present invention is configured to operate both the hydraulic torque wrench and the hydraulic spin down motor. It operates on a hydraulic system having pressurized line and a tank line. The pressurized line carries hydraulic fluid coming from the pump while the tank line returns the hydraulic fluid to the system reservoir. These lines enter the distribution block that houses the valve mechanism. They pass through a three position operator valve which controls how hydraulic fluid is directed through the combined wrench assembly.

The operator valve has three positions. In its center position, position A, the hydraulic fluid flow to the rundown motor is cut off as is the flow to the extension side of the hydraulic cylinder, while the retraction side is pressurized. In the left position, position B, the rundown motor is pressurized as is the retraction side of the hydraulic cylinder, while the extension side remains cut off from pressure. In the right position, position C, the retraction side is cut off from hydraulic pressure as is the rundown motor, while the extension side of the of the hydraulic cylinder is pressurized. The operator valve is preferably biased with a spring or other means to return to center position A when released by the operator. The preferred mechanisms for routing the hydraulic fluid through the distribution block to achieve the results described above is set forth in the detailed description of the preferred embodiment below.

DETAILED DESCRIPTION OF THE PREFERRED EMBODIMENT

Figure 1:
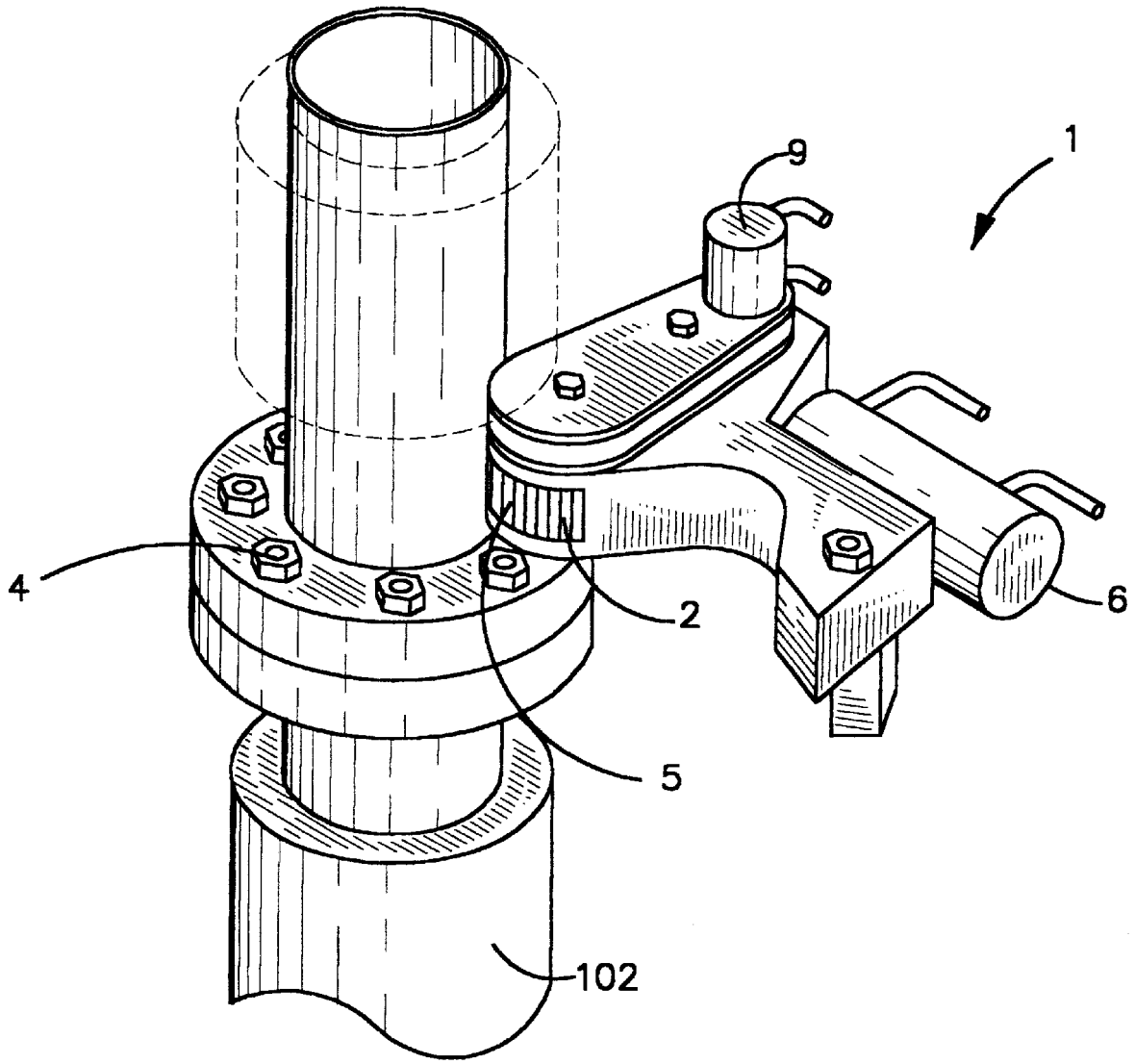
FIG. 1 is a perspective view of a preferred embodiment of the wrench assembly engaged with a riser.
Figure 2:
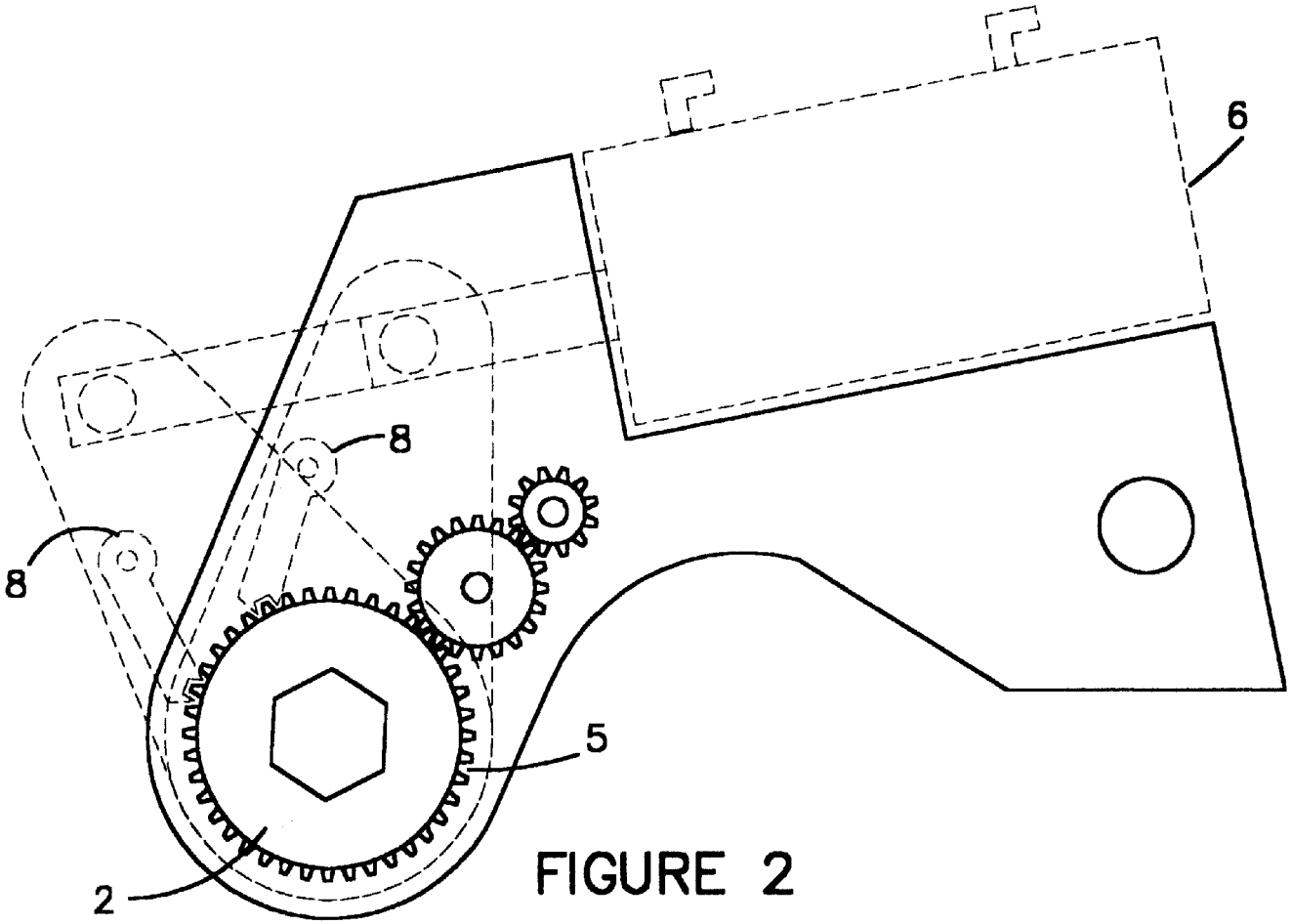
FIG. 2 is a top view and partial cut-away of a preferred embodiment of the wrench assembly.
Figure 3:
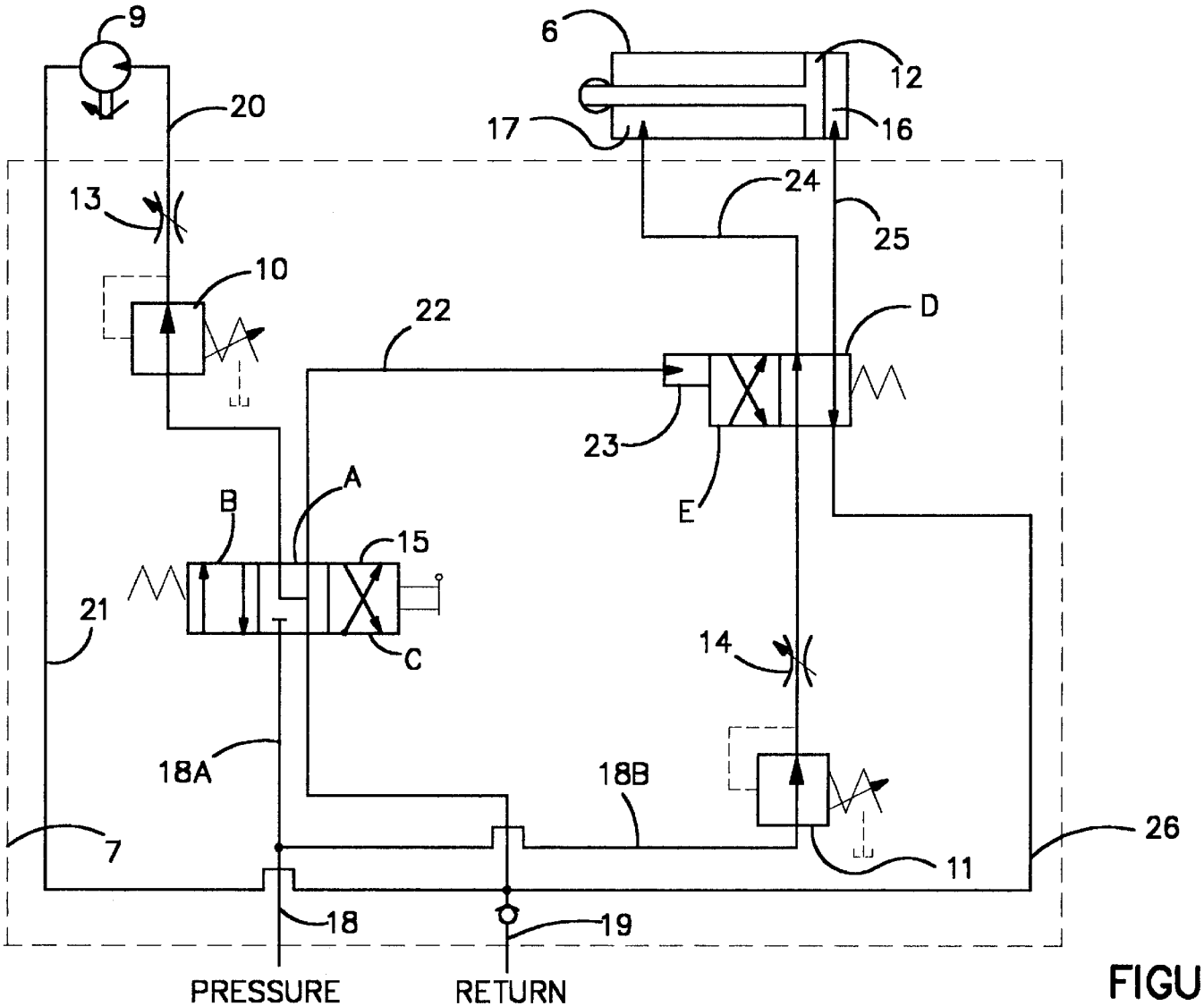
FIG. 3 is schematic drawing of the hydraulics of a preferred embodiment of the invention using a single four way pilot valve.
Figure 4:
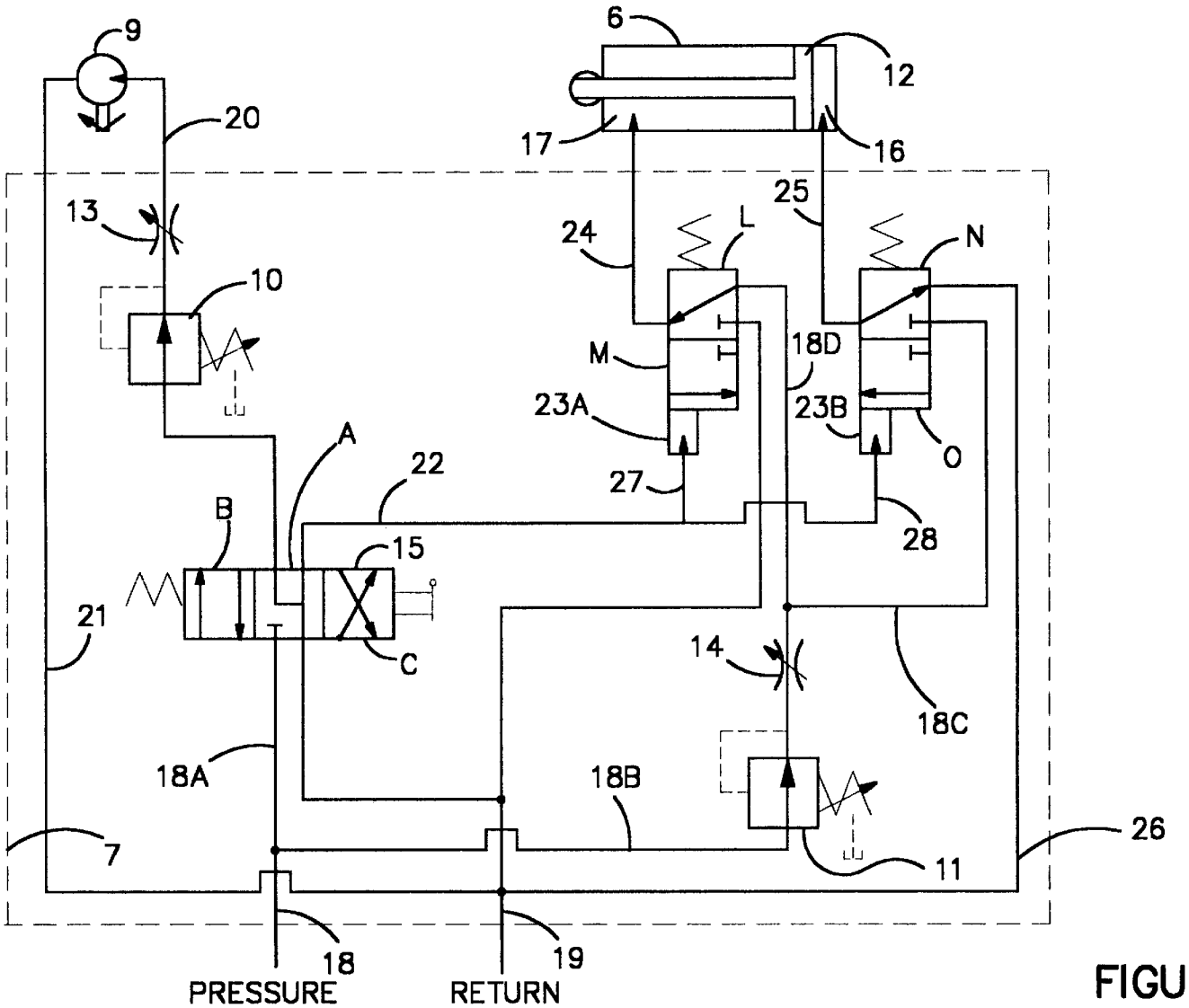
FIG. 4 is schematic drawing of the hydraulics of a preferred embodiment of the invention using two three way pilot valves.
Figure 5:
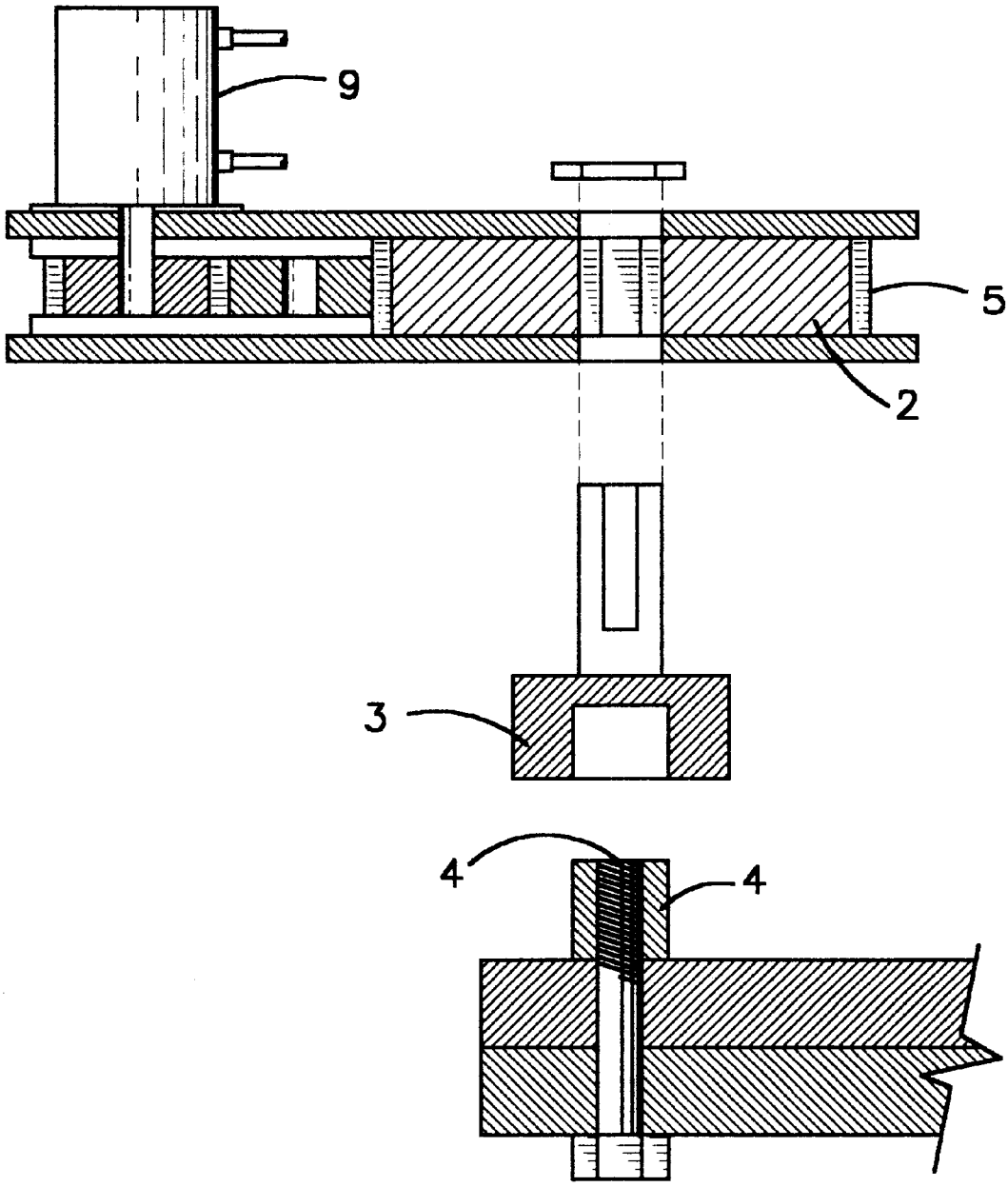
FIG. 5 is an exploded view of one preferred embodiment of a hydraulic wrench suitable for use with the hydraulic control valve disclosed herein.

Hydraulic wrench assembly 1 comprises a drive head 2 having a socket 3 configured to engage a threaded member 4, such as a nut or a bolt. Drive head 2 also comprises a plurality of ratchet teeth 5 radially positioned on drive head 2. Hydraulic wrench assembly 1 further comprises a hydraulic cylinder 6. Hydraulic cylinder 6 is configured to extend and retract a pawl 8 which is positioned to engage ratchet teeth 5 upon extension of pawl 8. When pawl 8 engages ratchet teeth 5, drive head 2, socket 3, and threaded member 4 may be rotated upon further extension of pawl 8, which will either tighten or loosen threaded member 4 depending upon the direction of rotation of drive head 2. Pawl 8 may retracted and extended again, further rotating drive head 3, socket 3, and threaded member 4 until the desired torque is reached or until threaded member 4 is adequately loosened.

Hydraulic wrench assembly 1 further comprises a spin down motor 9 which is preferably hydraulically driven and should be mechanically coupled to drive head 2 so that operation of spin down motor 9 will result in drive head 2, socket 3, and threaded member 4 being rotated. Typically, spin down motor 9 will rotate at about 585 rpm and will be configured to provide about 500 ft lbs of torque to threaded member 4. Spin down motor 9 will be used until threaded member 4 is snug, a condition that will be apparent when spin down motor 9 and drive head 2 stop turning.

Spin down motor 9 will stop turning when it "torques out." Hydraulic spin down motor 9 acts as blockage in the hydraulic line feeding it. As the pressure builds up, the pressurized fluid causes motor 9 to rotate which allows the fluid to pass and prevents the pressure from building up further. However, if something prevents motor 9 from rotating, the pressure will continue to increase until either that obstacle is overcome and motor 9 rotates allowing some of the fluid to pass or until relief is obtained elsewhere. As threaded member 4 gets tighter, it will obviously provide more and more resistance to the rotation of motor 9. Thus, as threaded member 4 gets tighter and tighter, the pressure in the hydraulic line will be forced ever higher. Relief is provided by motor torque control valve 10, which is set to open a predetermined pressure. When the pressure in the hydraulic line reaches a preset level, motor torque control valve 10 will open and allow the hydraulic fluid to flow to tank, avoiding motor 9. When this happens, motor 9 will stop turning. The torque exerted by motor 9 when the hydraulic pressure is sufficient to cause motor torque control valve 10 to open is the maximum torque that will be exerted by motor 9 with motor torque valve 10 in place. It is at this point that motor 9 is said to "torque out." Additional tightening must be performed with hydraulic cylinder 6.

The maximum torque exerted by hydraulic cylinder 6 is controlled by a cylinder torque control valve 11 in much the same way that the torque exerted by motor 9 is controlled by motor torque control valve 10. Cylinder 6 acts as a blockage in the hydraulic line feeding it. The pressure in the line and in cylinder 6 will increase until piston 12 moves, increasing the volume of cylinder 6 and relieving the pressure. When cylinder 6 is extending pawl 8 against ratchet teeth 5 to turn drive head 2 and threaded member 4, threaded member 4 will resist the extension of cylinder 6. When this happens, the pressure in the hydraulic line and in cylinder 6 will continue to increase until sufficient torque is generated to overcome the resistance of threaded member 4, at which point drive head 4 and threaded member 4 will be rotated, further tightening threaded member 4 and increasing the torque needed to tighten threaded member 4 further. As this continues, the pressure in the hydraulic line will continue to increase until the pressure is sufficient to open cylinder torque control valve 11. When this happens, piston 12 of cylinder 6 can be extended no further, and cylinder 6 is said to have "torqued out."

The torque exerted by motor 9 and cylinder 6 for each pound per square inch of pressure in the hydraulic lines can be calibrated. These figures will vary with individual hydraulic components, and should be readily obtainable from the manufacturer of the part. Once it is known, the maximum torque exerted by either component of wrench assembly 1 may set by the operator simply by adjusting the pressure at which motor torque control valve 10 or cylinder torque control valve 11 will open.

The speed of motor 9 or cylinder 6 may be controlled by a motor speed control valve 13 or a cylinder speed control valve 14. Both valves 13 and 14 operate by restricting the rate at which fluid flows through the hydraulic lines to motor 9 or cylinder 6. This will prevent cylinder 6 or motor 9 from extending, retracting or rotating too fast, which could lead to operator injury or to equipment damage. Speed control valves 13 and 14 should preferably be positioned downstream from motor torque control valve 10 or cylinder torque control valve 11, respectively.

The operation of wrench assembly 1 is controlled by a distribution block 7 from a three position operator control valve 15. Operator control valve 15 has a center position A in which motor 9 and the extension side 16 of cylinder 6 are not pressurized and are connected to the tank and in which retraction side 17 of cylinder 6 is pressurized. Operator control valve 15 is preferably spring biased to return to center position A when it is released. Operator control valve 15 also has a left position B in which motor 9 and retraction side 17 of cylinder 6 are pressurized, and extension side 16 of cylinder 6 is connected to the tank. Finally, operator control valve 15 has a right position C in which extension side 16 of cylinder 6 is pressurized and retraction side 17 and motor 9 are connected to the tank.

Distribution block 7 preferably contains a pressure line 18 and a tank line 19. Pressure line 18 preferably has motor branch 18A and a cylinder branch 18B. Motor branch 18A of pressure line 18 runs into operator control valve 15. When operator control valve 15 is in left position B, motor branch 18A is connected to motor hydraulic line 20 which contains motor torque control valve 10 and motor speed control valve 13. Motor hydraulic line 20 provides hydraulic fluid and pressure to motor 9, causing motor 9 to run. Motor tank line 21 allows hydraulic fluid to flow out of motor 9 to tank line 19. When operator control valve 15 is in either center position A or right position C, motor hydraulic line 20 is connected to tank line 19. Thus, when operator control valve 15 is in either position A or C, motor 9 will not run.

In one preferred embodiment, a pilot valve line 22 extends from operator control valve 15 to pilot valve 23. Additionally, cylinder branch 18B of pressure line 18 runs directly to pilot valve 23 without running through operational control valve 15. Pilot valve 23 has a first position D and a second position E. Pilot valve is preferably biased with a spring or other means into first position D.

A cylinder retraction line 24 and a cylinder extension line 25 extend from pilot valve 23 to retraction side 17 and extension side 16 of cylinder 6, respectively. When pilot valve 23 is in first position D, pilot valve 23 connects extension line 25 with cylinder tank line 26 which is connected to tank line 19. Pilot valve 23 also connects cylinder branch 18B of pressure line 18, which preferably contains cylinder torque control valve 11 and cylinder speed control valve 14, with cylinder retraction line 24, when pilot valve 23 is in first position D. Thus, when pilot valve 23 is in first position D, retraction side 17 of cylinder 6 is pressurized and extension side 16 is connected to the tank.

When pilot valve 23 is in second position E, pilot valve 23 connects extension line 25 with cylinder branch 18B of pressure line 18 and retraction line 24 with cylinder tank line 26. Thus, when pilot valve 23 is in second position E, extension side 17 is pressurized and retraction side 16 is connected to the tank.

As stated above, pilot valve 23 is preferably spring biased into first position D. When pilot valve line 22 is pressurized it will exert pressure against pilot valve 23 and, overriding the spring biasing, will move pilot valve 23 into second position E.

When operational control valve 15 is in center position A or left position B, pilot valve line 22 will be connected to tank line 19. Thus, when operational control valve 15 is in either center position A or left position B, pilot valve line 22 will not be under pressure and pilot valve 23 will be in first position D. However, when operational control valve 15 is in right position C, pilot valve line 22 will be pressurized and pilot valve 23 will move into second position E. This will pressurize extension side 16 and connect retraction side 17 to tank line 19, causing piston 12 and pawl 8 to be extended.

In the embodiment described above, pilot valve 23 is a four way directional control valve. However, in another embodiment, principally for use when space is at a premium, pilot valve 23 may be a pair of three way directional control valves 23A and 23B. In this embodiment, pilot valve line 22 will have a retraction branch 27 and an extension branch 28. Retraction branch 27 will connect pilot valve line 22 to pilot valve 23A and extension branch 28 will connect pilot valve line 22 to pilot valve 23B. Additionally, cylinder branch 18B of pressure line 18, will have an extension branch 18C and a retraction branch 18D. Extension branch 18C extends from cylinder branch 18B to pilot valve 23B and retraction branch 18D extends from cylinder branch 18B to pilot valve 23A. Pilot valve 23A is connected to retraction side 17 of cylinder 6 by cylinder retraction line 24, and pilot valve 23B is connected to extension side 16 of cylinder 6 by cylinder extension line 25. Pilot valves 23A and 23B control whether extension side 16 or retraction side 17 is pressurized.

Pilot valves 23A has a first position L and a second position M. Pilot valve 23A is preferably spring biased to remain in first position L. When pilot valve 23A is in first position L, pilot valve 23A will connect retraction line 24 to retraction branch 18D of pressure line 18. Thus, when pilot valve 23A is in first position L, retraction side 17 of cylinder 6 will be pressurized and piston 12 will be retracted.

When pilot valve 23 is in second position M, pilot valve 23A will connect retraction line 24 to tank line 19. Thus, when pilot valve 23A is in second position M, retraction side 17 of cylinder 6 will not be pressurized and piston 12 will be free to extend.

Pilot valve 23B also has a first position N and a second position O. Pilot valve 23B is preferably spring biased to remain in first position N. When pilot valve 23B is in first position N, pilot valve 23B will connect extension line 25 to tank line 19. Thus, when pilot valve 23B is in first position N, extension side 16 of cylinder 6 will not be pressurized and piston 12 will be free to retract.

When pilot valve 23B is in second position O, pilot valve 23B will connect cylinder extension line 25 to extension branch 18C of pressure line 18. Thus, when pilot valve 23B is in second position O, extension side 16 of cylinder 6 will be pressurized and piston 12 will extend.

When operator control valve 15 is in center position A or left position B, operator control valve 15 will connect pilot valve line 22, its retraction branch 27, and its extension branch 28 to tank line 19. Thus, when operational control valve 15 is in either center position A or left position B, neither pilot valve line 22 nor its retraction and extension branches 27 and 28 will be under pressure, and pilot valves 23A and 23B will be in first positions L and N. However, when operational control valve 15 is in right position C, pilot valve line 22, it retraction branch 27 and its extension branch 28 will be pressurized and pilot valves 23A and 23B will move into second positions M and O. Thus, when operational control valve 15 is in right position C, pilot valve 23A will connect retraction line 24 to tank line 19, and pilot valve 23B will connect cylinder extension line 25 to extension branch 18C of pressure line 18. Therefore, when operational control valve 15 is in right position C, retraction side 17 of cylinder 6 will not be pressurized and extension side 16 of cylinder 6 will be pressurized, resulting in the extension of piston 12.

In operation, distribution block 7 will preferably be mounted on wrench assembly 1. When wrench assembly 1 is used on an oil rig, the rig hydraulic lines will engage pressure line 18 and tank line 19. The operator will engage threaded member 4 with socket 3 of drive head 2. During make up, the operator will move operator control valve 15 from center position A to left position B. This will direct hydraulic fluid from pressure line 18 into motor branch 18A and on into spin down motor 9. When pressurized, spin down motor 9 will rotate, thereby turning socket 3 and threaded member 4 until spin down motor 9 torques out. When this happens, the operator will move operator control valve 15 into right position C. This will pressurize pilot valve line 22 and its extension and retraction branches 27 and 28, if present. This will move pilot valve 23 from first position D to second position E or pilot valves 23A and 23B from first positions L and N to second positions M and O. When pilot valve 23 or pilot valves 23A and 23B are in second positions E or M and O, hydraulic fluid will be directed to extension side 16 of cylinder 6 and retraction side 17 will be connected to tank line 19. Thus, when operator control valve 15 is in right position C, piston 12 and pawl 8 will extend and pawl 8 will engage ratchet teeth 5, turning drive head 2, socket 3, and threaded member 4. This will continue until piston 12 is fully extended.

When piston 12 is fully extended, the operator will return operator control valve 15 to center position A. This will connect pilot valve line 22 and its extension and retraction branches 27 and 28, if present, to tank line 19. In the absence of pressure in pilot valve line 22 or in extension or retraction branches 27 or 28, pilot valve 23 or pilot valves 23A and 23B will return will direct hydraulic fluid to retraction side 17 of cylinder 6 while extension side will be connected to tank line 19. Thus, when operator control valve 15 is in center position A, piston 12 and pawl 8 will retract out of engagement with ratchet teeth 5. When pawl 8 has fully disengaged ratchet teeth 5, the operator may return operator control valve 15 to right position C, and repeat the process until cylinder 6 torques out.

We claim:

1. A wrench assembly for use with a source of pressurized hydraulic fluid comprising:

a hydraulic wrench comprising a hydraulic cylinder having a retraction side and an extension side, said cylinder configured to extend and retract a pawl;

a drive head containing a plurality of teeth radially disposed on said drive head, said drive head further comprising a socket configured to engage a threaded member, whereby rotation of said drive head will effect rotation of said socket and of any threaded member which said socket may have engaged; wherein said hydraulic cylinder and said drive head are positioned relative to one another to allow said pawl to engage said teeth on said drive head upon extension of said pawl, whereby extension of said pawl will effect rotation of said drive head;

a hydraulic motor configured to rotate said drive head at a higher speed and lower torque than said cylinder and said pawl; and a hydraulic fluid distribution system comprising:

a pressure line connecting said hydraulic motor and said hydraulic wrench to said source of pressurized hydraulic fluid said pressure line having a cylinder branch configured to provide hydraulic fluid to said hydraulic cylinder of said hydraulic wrench, said cylinder branch having an extension branch and a retraction branch;

a tank line providing for discharge of said hydraulic fluid from said hydraulic wrench and said hydraulic cylinder; and an operator control valve having a manually selectable first, second, and third position, wherein said operator control valve is configured to direct hydraulic fluid to said retraction side of said cylinder when said operator control valve is in said first position; wherein said operator control valve is configured to direct hydraulic fluid to said hydraulic motor and to said retraction side of said cylinder when said operator control valve is in said second position; and wherein said operator control valve is configured to direct hydraulic fluid to said extension side of said cylinder when said operator control valve is in said third position.

2. A wrench assembly according to claim 1 further comprising a pilot valve having a first position and a second position, wherein said pilot valve is configured to allow the flow of hydraulic fluid to said retraction branch and to allow the flow of hydraulic fluid from said extension side of said hydraulic cylinder to said tank line when said pilot valve is in said pilot valve's first position, said pilot valve further configured to allow the flow of hydraulic fluid to said extension branch and to allow the flow of hydraulic fluid from said retraction side of said hydraulic cylinder to said tank line when said pilot valve is in said pilot valve's second position.

3. A wrench assembly according to claim 2 further comprising a pilot line extending from said operator control valve to said pilot valve, said pilot valve configured to move from said pilot valve's first position to said pilot valve's second position when said pilot line is pressurized, said operator control valve being further configured to connect said pilot line to said source of pressurized hydraulic fluid when said operator control valve is in said operator control valve's third position.

4. A wrench assembly according to claim 3 wherein said pilot valve is biased to return to said pilot valve's first position.

5. A wrench assembly according to claim 1 further comprising a first pilot valve having a first position and a second position, wherein said first pilot valve is configured to allow the flow of hydraulic fluid to said retraction branch when said first pilot valve is in said first pilot valve's first position, and wherein said first pilot valve is further configured to allow the flow of hydraulic fluid from said retraction side of said hydraulic cylinder to said tank line when said pilot valve is in said first pilot valve's second position.

6. A wrench assembly according to claim 5 further comprising a first pilot line extending from said operator control valve to said first pilot valve, said first pilot valve configured to move from said first pilot valve's first position to said first pilot valve's second position when said first pilot line is pressurized, said operator control valve being further configured to connect said first pilot line to said source of pressurized hydraulic fluid when said operator control valve is in said operator control valve's third position.

7. A wrench assembly according to claim 6 wherein said first pilot valve is biased to return to said pilot valve's first position.

8. A wrench assembly according to claim 6 further comprising a second pilot valve having a first position and a second position, wherein said second pilot valve is configured to allow the flow of hydraulic fluid from said extension side of said hydraulic cylinder to said tank line when said second pilot valve is in said second pilot valve's first position, and wherein said second pilot valve is further configured to allow the flow of hydraulic fluid to said extension branch when said second pilot valve is in said second pilot valve's second position.

9. A wrench assembly according to claim 8 further comprising a second pilot line extending from said operator control valve to said second pilot valve, said second pilot valve configured to move from said second pilot valve's first position to said second pilot valve's second position when said second pilot line is pressurized, said operator control valve being further configured to connect said second pilot line to said source of pressurized hydraulic fluid when said operator control valve is in said operator control valve's third position.

10. A wrench assembly according to claim 9 wherein said first pilot line and said second pilot line are combined in a single line.

11. A wrench assembly according to claim 9 wherein said second pilot valve is biased to return to said second pilot valve's first position.

12. A wrench assembly according to claim 1 further comprising a second pilot valve having a first position and a second position, wherein said second pilot valve is configured to allow the flow of hydraulic fluid from said extension side of said hydraulic cylinder to said tank line when said second pilot valve is in said second pilot valve's first position, and wherein said second pilot valve is further configured to allow the flow of hydraulic fluid to said extension branch when said second pilot valve is in said second pilot valve's second position.

13. A wrench assembly according to claim 12 further comprising a second pilot line extending from said operator control valve to said second pilot valve, said second pilot valve configured to move from said second pilot valve's first position to said second pilot valve's second position when said second pilot line is pressurized, said operator control valve being further configured to connect said second pilot line to said source of pressurized hydraulic fluid when said operator control valve is in said operator control valve's third position.

14. A wrench assembly according to claim 13 wherein said first pilot line and said second pilot line are combined in a single line.

15. A wrench assembly according to claim 13 wherein said second pilot valve is biased to return to said second pilot valve's first position.

16. A wrench assembly according to claim 1 wherein said cylinder branch contains a cylinder torque control valve, said cylinder torque control valve having an open position and a closed position, wherein said cylinder torque control valve is configured to allow said hydraulic fluid to flow through said cylinder branch in said open position and wherein said cylinder torque control valve is configured to prevent the flow of hydraulic fluid through said cylinder branch when said cylinder torque control valve is in said closed position.

17. A wrench assembly according to claim 16 wherein said cylinder torque control valve is configured to move from said open position to said closed position when the pressure in said cylinder branch reaches a pre-set level.

18. A wrench assembly according to claim 17 wherein the pressure at which said cylinder torque control valve will move from said open position to said closed position is adjustable.

19. A wrench assembly according to claim 1 wherein said pressure line contains a motor branch which provides hydraulic fluid to said hydraulic motor.

20. A wrench assembly according to claim 19 wherein said motor branch contains a motor torque control valve, said motor torque control valve having an open position and a closed position, wherein said motor torque control valve is configured to allow said hydraulic fluid to flow through said motor branch in said open position and wherein said motor torque control valve is configured to prevent the flow of hydraulic fluid through said motor branch when said motor torque control valve is in said closed position.

21. A wrench assembly according to claim 20 wherein said motor torque control valve is configured to move from said open position to said closed position when the pressure in said motor branch reaches a pre-set level.

22. A wrench assembly according to claim 21 wherein the pressure at which said motor torque control valve will move from said open position to said closed position is adjustable.

* * * * *